US005664499A

United States Patent [19]

Kingsmill

[11] Patent Number: 5,664,499

[45] Date of Patent: Sep. 9, 1997

[54] SKI LIFT LOADER AND UNLOADER

[76] Inventor: William Gault Kingsmill, 72 Howland Ave., Apartment 1, Toronto, Ontario, Canada, M5R 3B3

[21] Appl. No.: 705,892

[22] Filed: Aug. 28, 1996

[51] Int. Cl.[6] ..... B61B 1/00

[52] U.S. Cl. ..... 104/28; 104/173.1; 104/178

[58] Field of Search ..... 104/28, 31, 135, 104/173.1, 173.2, 178, 179, 180; 198/35 R, 37

[56] References Cited

U.S. PATENT DOCUMENTS

| | | | |
|---|---|---|---|
| 3,548,753 | 12/1970 | Thurston . | |
| 3,602,361 | 8/1971 | Cheronis . | |
| 3,896,738 | 7/1975 | Dubeta et al. | 104/173.2 |
| 4,223,609 | 9/1980 | Montagner | 104/20 |
| 4,270,899 | 6/1981 | Faulkner et al. | 193/35 R |
| 5,044,482 | 9/1991 | Kramer | 193/37 |
| 5,454,327 | 10/1995 | Goirand | 104/28 |

FOREIGN PATENT DOCUMENTS

| | | | |
|---|---|---|---|
| 430091 | 6/1991 | European Pat. Off. | 104/173.2 |
| 1461211 | 12/1965 | France | 104/173.2 |
| 196857 | 7/1938 | Switzerland | 104/173.2 |

*Primary Examiner*—S. Joseph Morano

[57] ABSTRACT

An apparatus for loading skiers on a ski lift consisting of a plurality of rollers the rollers being parallel to each other and perpendicular to the ski lift at least during the portion of its length past the loading point. The rollers rotate, thereby accelerating a skier who is standing on the rollers to a speed the same or substantially the same as the speed of the ski lift. The skier is thereby able to sit down comfortably on the chair while standing on the rollers. A second apparatus may be disposed at an unloading point whereby the skier is moved away from the ski lift and is decelerated in order to safely transfer to the mow.

18 Claims, 5 Drawing Sheets

SKI LIFT LOADER AND UNLOADER

FIELD OF THE INVENTION

The present invention relates to ski chair lifts and, more particularly, to an improved apparatus for loading and unloading skiers onto and from a chair lift.

BACKGROUND OF THE INVENTION

Despite the many advances that have been made in ski lift operation and design, the loading of skiers onto a chair lift and the unloading of skiers from a chair lift continue to be difficult and sometimes dangerous procedures.

There are two main types of chairlifts commonly used. These are fixed grip chairlifts and detachable grip high-speed chairlifts. In fixed grip chairlifts, since the chair moves relatively rapidly along the loading area, skiers encounter difficulties in reaching the loading point and sitting down comfortably on the chair because the skier is exposed to the shock of a chair which is moving at a faster speed than the skier. This can be especially difficult for small children. In detachable grip high-speed chairlifts, the chairs move at a slow speed at the loading point and then accelerate to a high speed for the journey uphill, but such chairlifts are complicated and more expensive to manufacture and operate. They also need expensive protection equipment to protect the detachable mechanism from the weather elements.

In U.S. Pat. No. 3,548,753 issued on Dec. 22, 1970 is disclosed a passenger loading installation having a conveyor belt by means of which skiers standing on the conveyor belt are accelerated to a velocity substantially the same as that of the cable. After embarkment of the passengers, the conveyor is stopped and the next passengers may step on the conveyor to be moved towards the loading point. However, this installation requires the use of a driving drum and an idler drum with the conveyor belt, which are expensive. Also, there is no deceleration stage to provide for safe unloading of passengers.

In U.S. Pat. Nos. 5,454,326 and 5,454,327 issued on Oct. 3, 1995 is disclosed a passenger loading installation having a conveyor belt with drums This system is also prohibitively expensive and while it assists with the loading of the skier, it dramatically increases the danger of unloading the skier by subjecting the skier to a shock while unloading.

Other conveyor belt systems have been proposed, some of which involve the skier sliding down a ramp onto a conveyor belt, thereby exposing the skier to a jolt when entering the ramp and again when the skier is being seated on the moving chair. In previous systems, when disembarking from the chair, the skier is often forced to ski down a ramp which can be hazardous, leading to unnecessary injury.

The use of rollers in connection with ski tows or lifts is disclosed in U.S. Pat. No. 4,223,609 issued on Sep. 23, 1980 and U.S. Pat. No. 3,602,361 issued on Aug. 31, 1971. However, in U.S. Pat. No. 4,223,609, the skier is propelled by a pusher element and in U.S. Pat. No. 3,602,361, by powered handrails onto a moving conveyor belt type tow. Both systems are complicated and awkward for the skier to use.

SUMMARY OF THE INVENTION

An object of one aspect of the present invention is to provide an improved apparatus for loading and unloading skiers from a ski lift that will minimize the sudden contact of the chair with the skier and enable the lift to be operated more quickly, more safely and more efficiently with low installation and maintenance costs.

In one aspect of the present invention, these and other objectives and advantages are achieved by providing an apparatus for loading a skier onto a ski lift which moves at a speed and in a direction to carry the skier up a ski hill, the apparatus comprising:

a) a plurality of rollers positioned parallel to each other, in close proximity to each other and positioned perpendicular to the direction of movement of the ski lift;

b) the plurality of rollers comprising a first roller further downhill and a last roller closer uphill;

c) means for rotating the rollers in the direction of movement of the ski lift whereby the skier can stand on the rollers near the first roller and be accelerated to a speed the same as or substantially the same as the speed of the ski lift to an embarking point so as to facilitate embarking on the ski lift by the skier.

In another aspect of the present invention, there is further provided an apparatus for loading a skier onto a ski lift which moves at a speed and in a direction to carry the skier up a ski hill, the apparatus comprising:

a) a plurality of rollers comprising a First set of loading rollers, a second set of acceleration rollers and a third set of constant speed rollers, the rollers being positioned parallel to each other, in close proximity to each other and positioned perpendicular to the direction of the ski lift;

b) the plurality of rollers comprising a first roller further downhill and a last roller further uphill;

c) means for rotating and means for controlling the speed of rotation of the first set of loading rollers such that every loading roller is stationary when the skier steps onto the loading rollers, and the loading rollers begin to rotate thereafter;

d) means for rotating the rollers in the second set of acceleration rollers such that each subsequent roller from the first roller to the last roller in the second set rotates at a speed faster than the preceding roller, thereby the last roller rotates at the fastest speed;

e) means for rotating the rollers in the third set of constant speed rollers such that every roller in the third set rotates at a constant speed, which constant speed is the same or substantially the same as the speed of the ski lift;

whereby the skier can stand on the first set of loading rollers and be accelerated from a stationary position and moved onto the second set of acceleration rollers which accelerate the skier to a speed the same or substantially the same as the speed of the ski lift to an embarking point thereby facilitating embarking on the ski lift at the embarking point or on the third set of constant speed rollers.

In a further aspect of the present invention, an apparatus is provided for unloading a skier from a ski lift which moves at a speed and in a direction to carry the skier up a ski hill, the apparatus comprising:

f) a plurality of rollers positioned parallel to each other, in close proximity to each other and positioned perpendicular to the direction of movement of the ski lift;

g) the plurality of rollers comprising a first roller further downhill and a last roller closer uphill;

h) means for rotating the rollers in the direction of movement of the ski lift:

whereby the skier can stand on the rollers near the first roller and be moved away from the ski lift so as to facilitate disembarking from the ski lift.

Another aspect of the present invention provides an apparatus for unloading a skier from a ski lift which moves at a speed and in a direction to carry the skier up a ski hill, the apparatus comprising:

i) a plurality of rollers comprising a first set of unloading rollers and a second set of deceleration rollers, the rollers being positioned parallel to each other, in close proximity to each other and positioned perpendicular to the direction of the ski lift;

j) the plurality of rollers comprising a first roller further downhill and a last roller closer uphill;

k) means for rotating the rollers in the first set of unloading rollers such that every roller in the first set rotates at a constant speed, which constant speed is faster than the speed of the ski lift;

l) means for rotating the rollers in the second set of acceleration roller such that each subsequent roller from the first roller to the last roller in the second set rotates at a speed slower that the preceding roller, thereby the last roller rotates at the slowest speed or does not rotate;

whereby the skier can stand on the first set of unloading rollers and be carried away from the ski lift and moved onto the second set of deceleration rollers and be slowed down, thereby facilitating disembarking from the ski lift.

BRIEF DESCRIPTION OF THE DRAWINGS

One embodiment of the present invention will be described in greater detail with reference to the accompanying drawings, in which.

Figure 1:
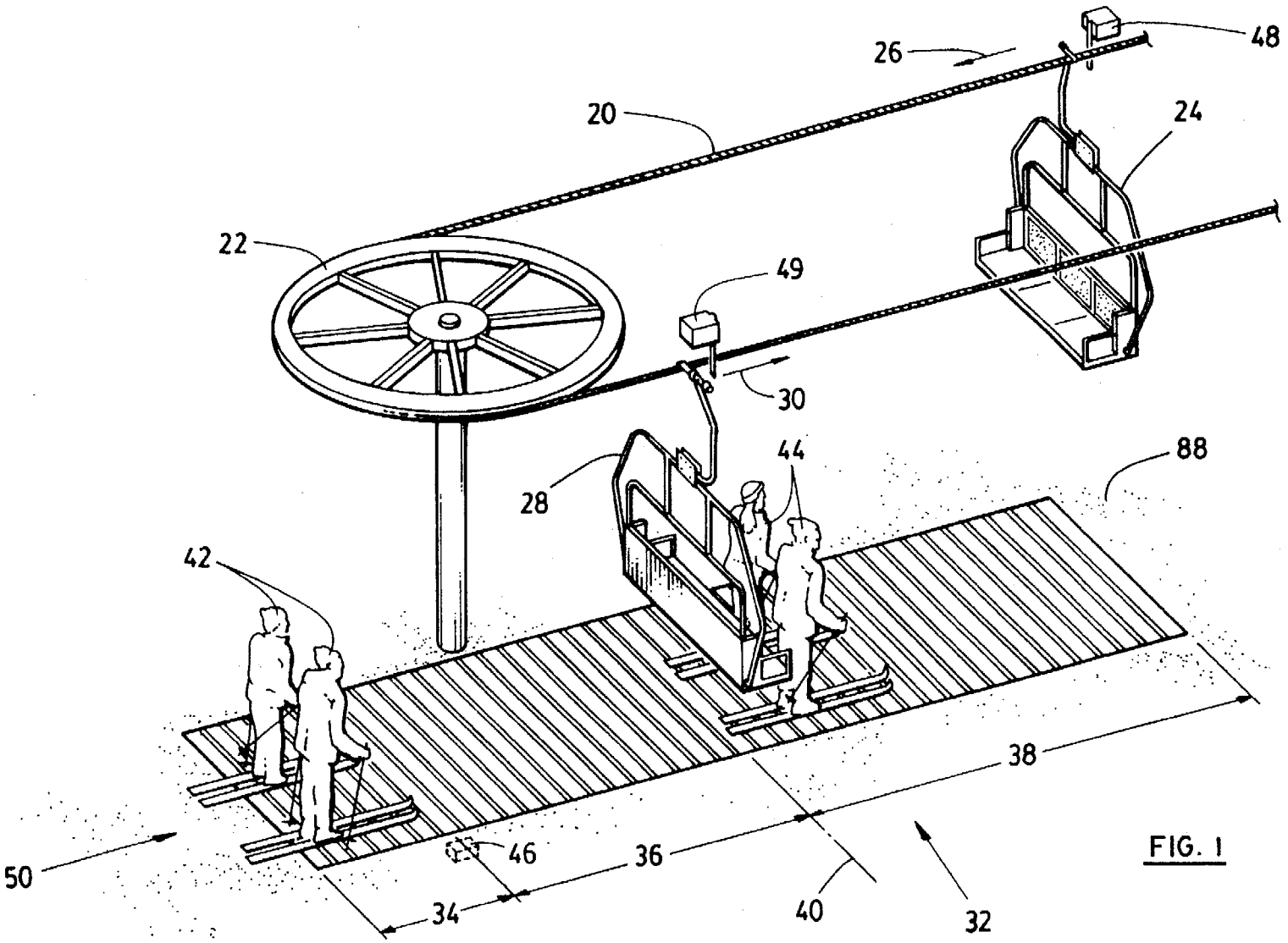
FIG. 1 is a perspective view of the roller apparatus and a chair lift of the preferred embodiment of the present invention at the downhill portion of a ski hill.

In the drawings, preferred embodiments of the invention are illustrated by way of example. It is to be expressly understood that the description and drawings are only for the purpose of illustration and as an aid to understanding preferred embodiments of the present invention, and are not intended as a definition of the limits of the invention.

DETAILED DESCRIPTION OF THE PREFERRED EMBODIMENT OF THE INVENTION

Referring to the drawings, FIG. 1 illustrates the preferred embodiment of the invention installed at the lower end of a ski chair lift at the bottom of a hill, although it will be understood that passengers can be loaded by the apparatus of the present invention at any loading point along the path of the lift. The preferred embodiment of the invention is further illustrated in conjunction with a chair lift having chairs which hold three passengers apiece, but this is not limiting inasmuch as the present invention would work equally well in loading chairs holding more or fewer passengers. Furthermore, although the preferred embodiment of the invention is illustrated in conjunction with a chair lift, the present invention will also work equally well with other types of over ground lifts other than chair lifts.

FIG. 1 illustrates a chair lift having a ski lift cable 20 which passes around a wheel 22 at the lower end of the ski slope. Chairs are suspended from ski lift cable 20 in the usual manner where they travel empty down the slope, around the wheel 22 and up the ski hill after picking up passengers. Such chairlifts are well known. A downhill chair 24 is shown travelling empty down the slope in the direction of the arrow 26 and around the wheel 22. An uphill chair 28 is also shown, having already passed around the wheel 22, travelling up the slope in the direction of the arrow 30.

A plurality of rollers 32 is provided adjacent the wheel 22 which rollers are positioned parallel to each other and perpendicular to the ski lift cable so that the axis of the rollers is collinear with the path of the chair lift, that is, collinear with ski lift cable 20. The rollers consist of three sections: the loading rollers 34, the acceleration rollers 36 and the constant speed rollers 38. The point where the acceleration rollers 36 and the constant speed rollers 38 meet is referred to as the embarking point 40 Skiers 42 are depicted standing on the loading rollers 35, Skiers 44 are depicted standing on the constant speed rollers, immediately uphill of the embarking point 40. A magnetic clutch 46 is indicated at the junction of the loading rollers 34 and the acceleration rollers 36. A stop switch 48 is positioned adjacent ski lift cable 20 slightly uphill from the downhill chair 24. A start switch 49 is positioned adjacent ski lift cable 20 immediately uphill of the embarking point 40. An arrow is indicated 50 showing the direction of approach of the skiers 42 and 44.

Figure 2:
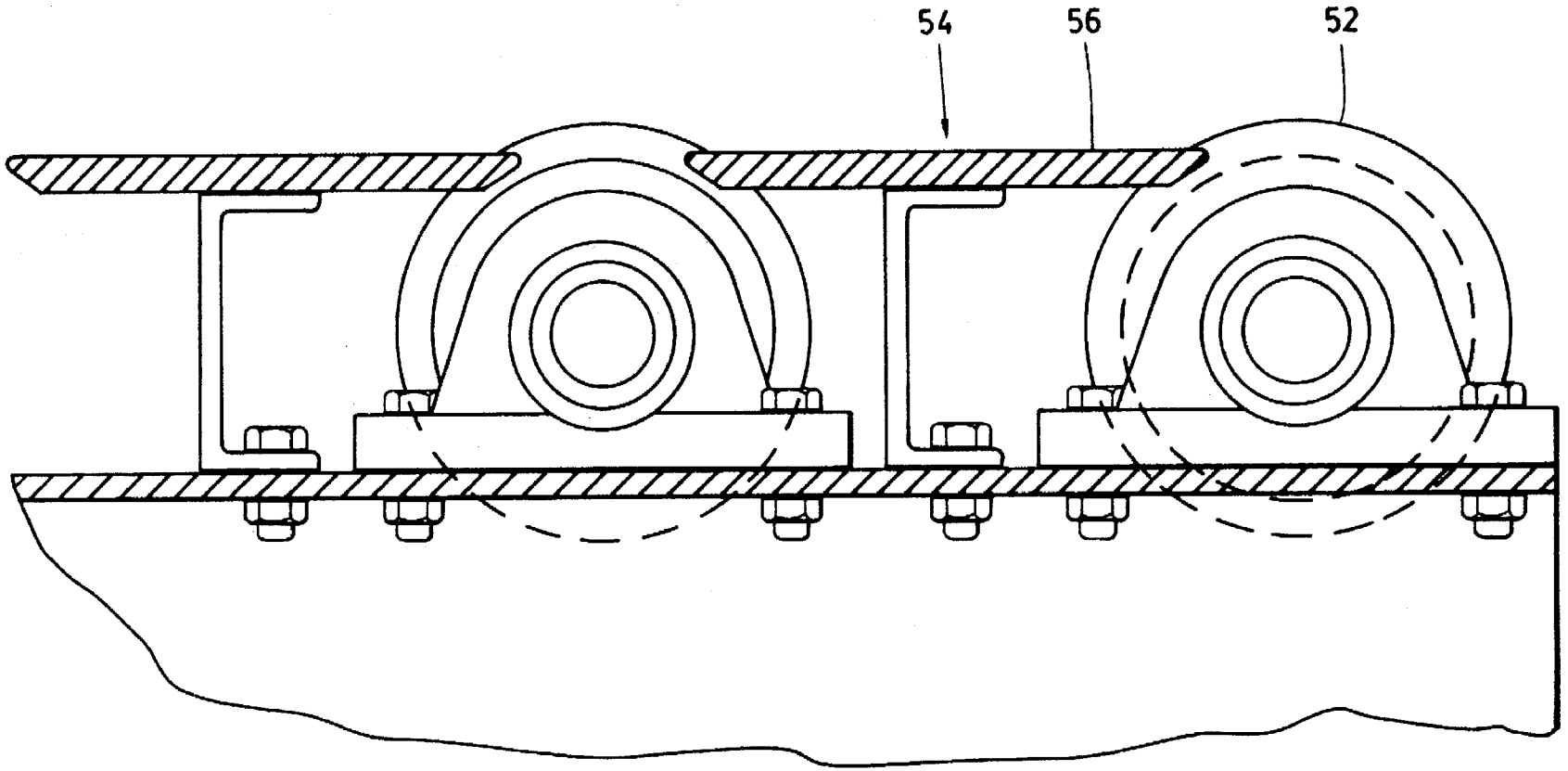
FIG. 2 is a side view of two rollers used in the embodiment of FIG. 1.

As illustrated in FIG. 2, a side view of two rollers 52 is shown. In the preferred embodiment, between the rollers are comb plates 54 whose teeth fit into the grooves in the rollers 52. The rollers preferably consists of grooved moulded rubber vulcanised seal onto a steel sleeve but any suitable material may be used.

As illustrated in FIG. 2, the comb plates 54 are preferably, but not necessarily, positioned so that the upper surface of the comb plate 56 is approximately one quarter of an inch below the top surface of tho rollers 52. The comb plates may consist of any suitable substance such as, but not limited to TEFLON.

Figure 3:
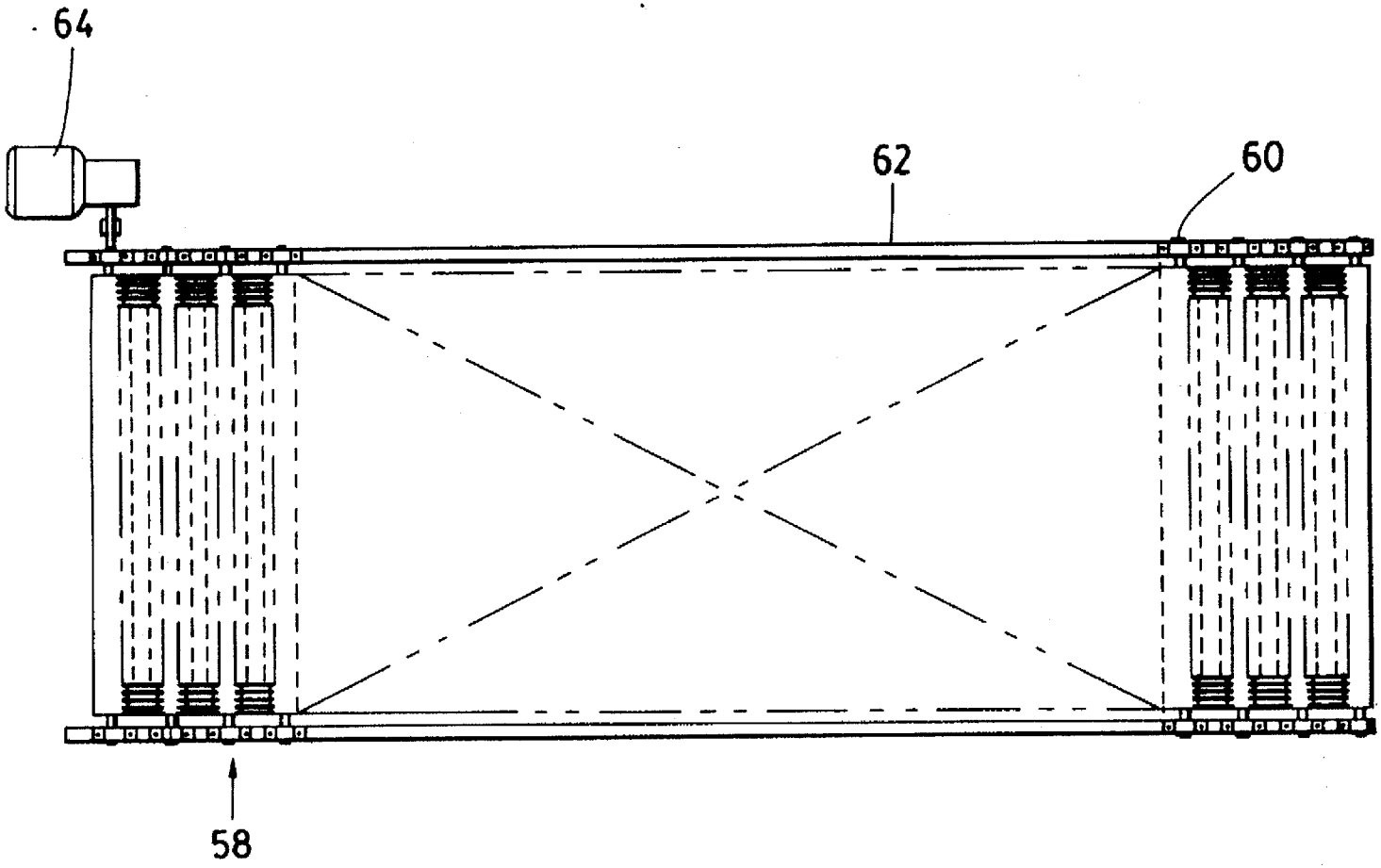
FIG. 3 is a top plan view of a potion of the roller apparatus of the embodiment of FIG. 1.

As shown in FIG. 3, the assembly of the rollers may be a series of modules 58 consisting of three rollers (although different numbers of rollers could also be used) set in roller bearings 60 and mounted on a beam 62. A motor 64 is mounted on the apparatus.

Figure 4:
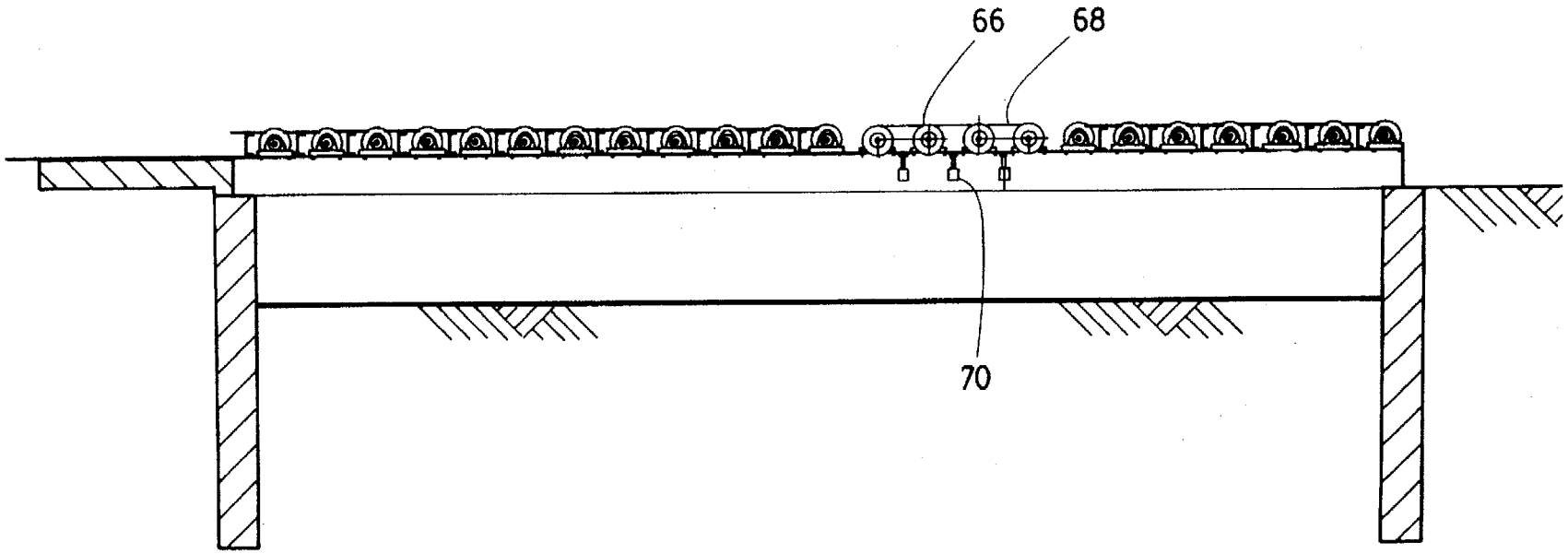
FIG. 4 is side view of a portion of the roller apparatus of the embodiment of FIG. 1.

As illustrated in FIG. 4, each roller in the preferred embodiment will contain a sprocket 66 which will be driven by a series of drive chains 68 which are driven by the motor 64. In the preferred embodiment of 3 rollers per module, every drive chain will surround three rollers with the next drive chain overlapping the preceding drive chain by one roller. Chain tensioners 70 are provided to control the tension of the drive chains. The assembled modules will be attached together by conventional means. In the preferred embodiment, the loading rollers 34 and the acceleration rollers 36 contain a sprocket 66 which will be smaller than the sprocket in the roller preceding it in the direction of the arrow 26. The constant speed rollers 38 all contain a similar sized sprocket.

Figure 5:
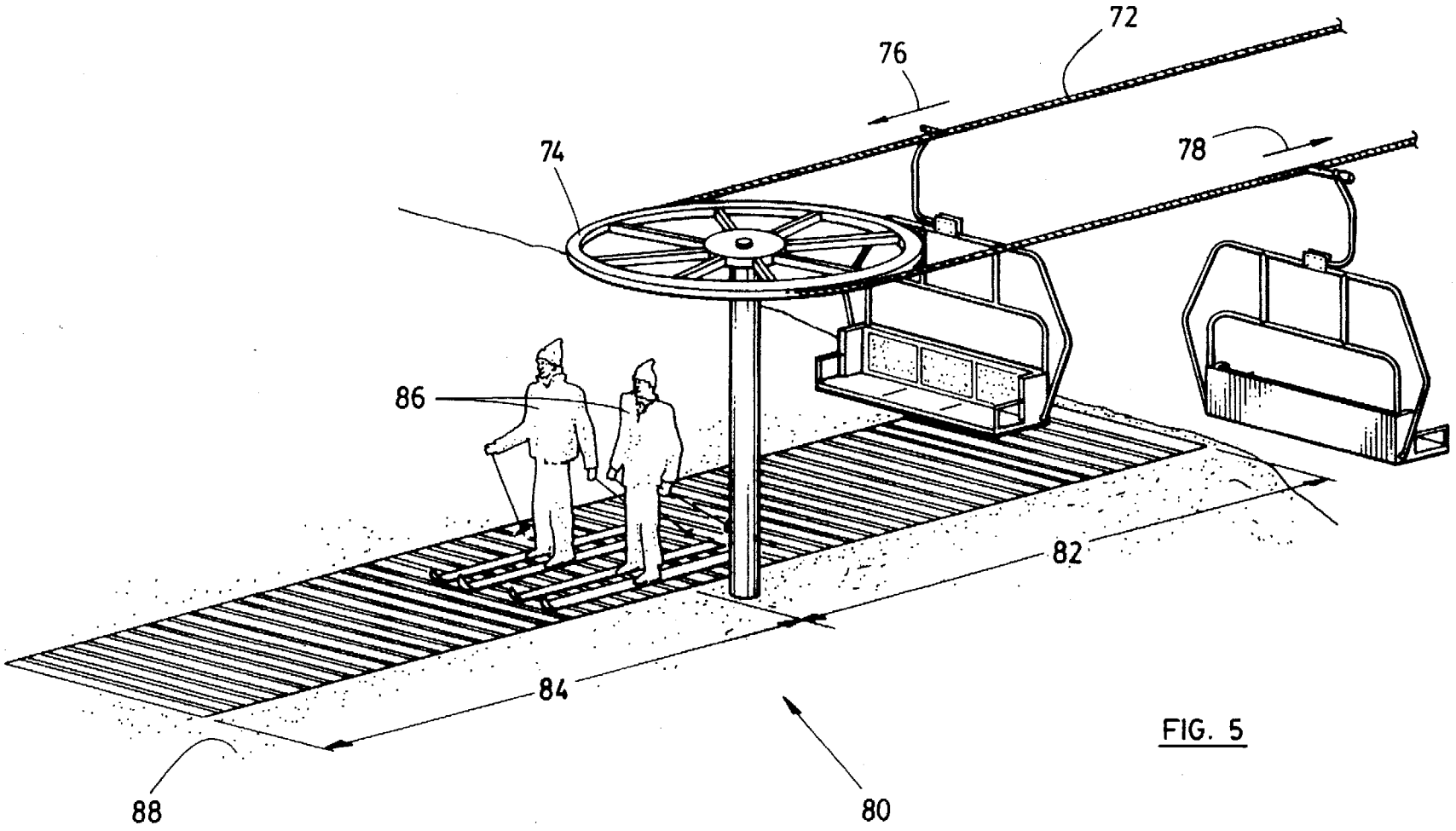
FIG. 5 is a perspective view of the roller apparatus and a chair lift of the preferred embodiment of the present invention at the unloading portion.

FIG. 5 illustrates the preferred embodiment of the present invention installed at the upper end of a ski chair lift at the top of a hill, although it will be understood that passengers can be unloaded by the apparatus of the present invention at any unloading point along the path of the lift. FIG. 5 illustrates a chair lift having a ski lift cable 72 which passes around a wheel 74 at the upper end of the ski slope. Chairs are suspended from ski lift cable 72 in the usual manner where they travel uphill carrying passengers in the direction of the arrow 76 where the passengers disembark. Chairs then travel empty around the wheel 72 and downhill in the direction of the arrow 78.

A plurality of rollers 80 is provided adjacent the wheel 74 which rollers are positioned parallel to each other and perpendicular to the ski lift cable so the axis of the rollers is collinear with the path of the chair lift, that is, collinear with ski lift cable 72. The rollers consist of two sections: the unloading rollers 82 and the deceleration rollers 84. Skiers 86 are depicted on the rollers 80. Snow 88 is illustrated at the uphill end of the deceleration rollers. As described above, the rollers are driven by a series of drive chains and sprockets whereby the speed of rotation of each individual roller is determined by the size of the sprocket in that particular roller. Power is transmitted to the drive chains by a motor as described above.

In operation, skiers approach the rollers 32 at the downhill end 50 of the system in line in the usual manner, with one skier positioning himself on one side of the roller apparatus and the other on the opposite side of the roller apparatus at its downhill end 50. The acceleration rollers 36 and the constant speed rollers 38 are being driven by the motor 64 and the drive chains 68 where every acceleration roller rotates faster than the roller preceding it due to the decreasing sizes of the sprockets in each roller. The constant speed rollers 38, on the other hand, are rotating at the same speed which speed is the same or substantially the same as that of the chair lift. The loading rollers 34 are, depending on the activity of the stop switch 48 and start switch 49 described below, either stationary or rotating. A marker is indicated on the rollers at the junction of the loading rollers 34 and the acceleration rollers 36 to indicate to the skiers as to where the loading rollers 34 end and the acceleration rollers 36 begin.

At the start of the cycle, the loading rollers 34 are rotating until the downhill chair 24 passes the stop switch 48 which will disengage the magnetic clutch 46, thereby causing the loading relies 34 to stop rotating and allowing skiers 42 to step onto the loading rollers 34 while the loading rollers 34 are stationary Skiers 42 step onto the loading rollers. As the uphill chair 28 passes the start switch 49, the start switch 49 engages the magnetic clutch 46 which is connected to the drive chains 66, thereby causing the loading rollers 34 to rotate in the same manner as the acceleration rollers 36 wherein every roller will rotate faster than the roller preceding it due to the decreasing size of the sprockets in each loading roller.

As skiers 42 move from the loading rollers 34 onto the acceleration rollers 36, skiers 42 will continue to be accelerated by the rotation of the acceleration rollers 36 to the embarking point 40 to a speed which will be the same or substantially the same speed as that of the ski lift cable 20 where skiers 42 will assume the position of skiers 44. In the meantime, the downhill chair 24 will have passed around the wheel 22 add will be in the position of the uphill chair 28. Skiers 44 will then be travelling on the constant speed rollers 38 at the same or substantially the same speed as that of the ski lift cable 20 and will be seated on the uphill chair 28 sometime before the end of the constant speed rollers 38.

The cycle will then be repeated whereby another chair which has moved into the position of the downhill chair 24 will have passed the stop switch 48 which will again disengage the magnetic clutch 46, thereby causing the loading rollers 34 to stop rotating and allowing the next skier to step onto the loading rollers 34 which begin to rotate once the uphill chair 28 has passed the start switch 49.

The number of loading rollers 34, acceleration rollers 36 and constant speed rollers 38 and the position of the stop switch 48 and start switch 49 will be determined by the assembler on the basis of the type of lift to which the roller apparatus is being fitted to. The assembler will therefore take into account, among other things, the speed of the ski lift to determine the number of rollers, the size of the sprockets the position of the stop switch 48 and the start switch 49 in order to accelerate the skiers to the requisite speed. The assembler may also, of course, adjust the size of the sprockets so that similar sized sprockets are used in all or a portion of the loading rollers 34 or a portion of the acceleration rollers 36 as long as the overall object of accelerating the skiers to the same or substantially the same speed as the chairlift is achieved.

It is to be understood, of course, that the length of the roller apparatus, the time interval during which the rollers accelerate the skiers from their stationary position to their terminal speed on the rollers and the position of the switches 48 and 49 are all chosen so that the uphill chair 28 and the skiers are travelling at the same or substantially the same speed when the uphill chair 28 catches up to the skiers at the embarking point 40.

For unloading passengers from the chair lift, a plurality of rollers 80 is provided which rollers are positioned parallel to each other and perpendicular to the lift cable so that the axis of the rollers 80 is colinear with the path of the chair lift, that is, colinear with the lift cable 72 at the point at which passengers disembark from the chair. The plurality of rollers 80 are illustrated installed adjacent the upper wheel 74 although it will be understood that passengers can be unloaded by such an unloading apparatus at any point along the path of the lift. In the preferred embodiment, the rollers consist of two sections: the unloading rollers 82 and the deceleration rollers 84.

As shown in FIG. 5 of the preferred embodiment, in the unloading rollers 82, every roller in the direction of the arrow 76 will rotate at the same speed which is faster than the speed of the ski lift cable 72 whereby the skier will be accelerated away from the chair when the skier dismounts from the chair. In the deceleration rollers 84, every roller rotates slower than the roller preceding it until the skier gradually slows down or stops moving and transfers to the snow 88.

As described above, the rollers in the preferred embodiment are driven by a series of drive chains and sprockets whereby the speed of each individual roller is determined by the size of the sprocket in that particular roller. Power is transmitted to the drive chains by a variable speed motor as described above.

In operation, the skiers 86 stand up from the chair near the downhill end of the unloading rollers 82 and are moved away from the chair by the unloading rollers 82 and onto the deceleration rollers 84 where the skiers 86 are slowed down as they travel over the deceleration rollers 84 until they transfer to the snow 88. In another embodiment of the invention, the skiers 86 travel over the deceleration rollers 84 until they come to a stop at the uphill end of the deceleration rollers 84.

Again, the number of unloading rollers 82 and deceleration rollers 84 and the size of the sprockets will be determined by the assembler on the basis of the type of lift to which the roller apparatus is being fitted to. The assembler will therefore take into account, among other things, the speed of the ski lift to determine the number of rollers and the size of the sprockets needed to move the skiers away from the chair and to decelerate the skiers. The assembler may also, of course, adjust the size of the sprockets so that similar sized sprockets are used in a portion of the unloading rollers 82 or a portion of the deceleration rollers 84 as long as the overall object of moving the skiers away from the ski lift and decelerating the skiers is achieved.

In one embodiment of the invention, each roller is approximately 6 inches in diameter and six to eight feet in length. The rollers are mounted on a beam which is approximately 6 inches in width. The rollers are positioned approximately one foot apart from each other.

In another embodiment of the invention, the drive chains are replaced with other suitable driving means such as, but not limited to, gears.

Modifications and alterations to the roller assembly of the present invention are contemplated and are within the scope of the invention.

The embodiments of the invention in which an exclusive property or privilege is claimed are defined as follows:

1. An apparatus for loading a skier onto a ski lift which moves at a speed and in a direction to carry the skier up a ski hill, the apparatus comprising:

(a) a plurality of rollers positioned parallel to each other, in close proximity to each other and positioned perpendicular to the direction of movement of the ski lift;

(b) the plurality of rollers comprising a first roller further downhill and a last roller closer uphill;

(c) means for rotating the rollers in the direction of movement of the ski lift such that every roller from the first roller to the last roller rotates at a speed faster than the preceding roller, thereby the last roller rotates at the fastest speed;

whereby the skier can stand on the rollers near the first roller and be accelerated to a speed the same as or substantially the same as the speed of the ski lift to an embarking point so as to facilitate embarking on the ski lift by the skier.

2. The apparatus of claim 1 wherein the rollers contain sprockets whereby each subsequent roller from the first roller to the last roller has a sprocket which is smaller than the roller preceding it.

3. An apparatus for loading a skier onto a ski lift which moves at a speed and in a direction to carry the skier up a ski hill, the apparatus comprising:

(a) a plurality of rollers comprising a first set of loading rollers, a second set of acceleration rollers and a third set of constant speed rollers, the rollers being positioned parallel to each other, in close proximity to each other and positioned perpendicular to the direction of the ski lift;

(b) the plurality of rollers comprising a first roller further downhill and a last roller further uphill;

(c) means for rotating and means for controlling the speed of rotation of the first set of loading rollers such that every loading roller is stationary when the skier steps onto the first set of loading rollers, and the loading rollers begin to rotate thereafter;

(d) means for rotating the rollers in the second set of acceleration rollers such that each subsequent roller from the first roller to the last roller in the second set rotates at a speed faster than the preceding roller, thereby the last roller rotates at the fastest speed;

(e) means for rotating the rollers in the third set of constant speed rollers such that every roller in the third set rotates at a constant speed, which constant speed is the same or substantially the same as the speed of the ski lift;

whereby the skier can stand on the first set of loading rollers and be accelerated from a stationary position and moved onto the second set of acceleration rollers which accelerate the skier to a speed the same as or substantially the same as the speed of the ski lift to an embarking point, thereby facilitating embarking on the ski lift at the embarking point or on the third set of constant speed rollers.

4. The apparatus of claim 3 wherein either or both of the loading rollers and acceleration rollers each contain sprockets whereby each subsequent roller from the first roller to the last roller has a sprocket which is smaller than the roller preceding it.

5. The apparatus of claim 3 wherein the constant speed rollers each contain sprockets whereby each subsequent roller from the first roller to the last roller has a sprocket which is the same size as the sprocket preceding it.

6. The apparatus of claims 1 or 3 wherein the means for rotating the rollers is one or more drive chains driven by a motor.

7. The apparatus of claim 6 wherein the speed of the motor is synchronized to the speed of a chairlift motor that drives the ski lift.

8. The apparatus of claims 1 or 3 wherein the rollers are assembled in modules of two or more rollers attached to drive chains whereby the drive chain attached to one module overlaps by one roller with the drive chain attached to the module preceding it.

9. The apparatus of claim 3 wherein the means for controlling the speed of rotation of the loading rollers is a first switch and a second switch, the first switch being a start switch positioned adjacent the uphill path of the ski lift immediately uphill of the embarking point and the second switch being a stop switch positioned adjacent the downhill path of the ski lift, whereby the start switch engages a clutch when a first chair is at the embarking point and the stop switch disengages the clutch when a second chair has passed the stop switch.

10. An apparatus for unloading a skier from a ski lift which moves at a speed and in a direction to carry the skier up a ski hill, the apparatus comprising:

(a) a plurality of rollers positioned parallel to each other, in close proximity to each other and positioned perpendicular to the direction of movement of the ski lift;

(b) the plurality of rollers comprising a first roller further downhill and a last roller closer uphill;

(c) means for rotating the rollers in the direction of movement of the ski lift wherein the means for rotating the rollers is such that every roller from the first roller to the last roller rotates at a constant speed which is faster than the speed of the ski lift;

whereby the skier can stand on the rollers near the first roller and be moved away from the ski lift so as to facilitate disembarking from the ski lift.

11. The apparatus of claim 10 wherein the rollers contain sprockets whereby each subsequent roller from the first roller to the last roller has a sprocket which is the same size as the sprocket preceding it.

12. An apparatus for unloading a skier from the ski lift which moves at a speed and in a direction to carry the skier up a ski hill, the apparatus comprising:

(a) a plurality of rollers comprising a first set of unloading rollers and a second set of deceleration rollers, the rollers being positioned parallel to each other, in close proximity to each other and positioned perpendicular to the direction of the ski lift;

(b) the plurality of rollers comprising a first roller further downhill and a last roller closer uphill;

(c) means for rotating the rollers in the first set of unloading rollers such that every roller in the first set rotates at a constant speed, which constant speed is faster than the speed of the ski lift;

(d) means for rotating the rollers in the second set of deceleration rollers such that each subsequent roller from the first roller to the last roller in the second set rotates at a speed slower than the preceding roller, thereby the last roller rotates at the slowest speed or does not rotate;

whereby the skier can stand on the first set of unloading rollers and be carried away from the ski lift and moved onto the second set of deceleration rollers and be slowed down, thereby facilitating disembarking from the ski lift.

13. The apparatus of claims 10 or 12 wherein the rollers consist of grooved molded rubber vulcanized onto a steel sleeve.

14. The apparatus of claim 12 wherein the first set of unloading rollers contain sprockets whereby each subsequent roller from the first roller to the last roller has a sprocket which is the same size as the sprocket preceding it.

15. The apparatus of claim 12 wherein the deceleration rollers contain sprockets whereby each subsequent roller from the first roller to the last roller has a sprocket which is smaller than the sprocket preceding it.

16. The apparatus of claims 10 or 12 wherein the means for rotating the rollers is one or more drive chains driven by a motor.

17. The apparatus of claim 16 wherein the speed of the motor is synchronized to the speed of a chairlift motor that drives the ski lift.

18. The apparatus of claims 10 or 12 wherein the rollers are assembled in modules of two or more rollers attached to drive chains whereby the drive chain attached to one module overlaps by one roller with the drive chain attached to the module preceding it.

* * * * *